United States Patent [19]

Matsuzaka et al.

[11] Patent Number: 4,510,234

[45] Date of Patent: Apr. 9, 1985

[54] SILVER HALIDE PHOTOGRAPHIC EMULSION

[75] Inventors: Syoji Matsuzaka, Hino; Makoto Kajiwara; Masanobu Miyoshi, both of Odawara; Kiyoshi Yamashita, Hino, all of Japan

[73] Assignee: Konishiroku Photo Industry Co., Ltd., Tokyo, Japan

[21] Appl. No.: 530,024

[22] Filed: Sep. 7, 1983

[30] Foreign Application Priority Data

Sep. 10, 1982 [JP] Japan ..... 57/158463

[51] Int. Cl.[3] ..... G03C 1/02

[52] U.S. Cl. ..... 430/557; 430/558; 430/567; 430/568

[58] Field of Search ..... 430/557, 558, 567, 568

[56] References Cited

U.S. PATENT DOCUMENTS

| | | | |
|---|---|---|---|
| 4,144,071 | 3/1979 | Shiba et al. | 430/505 |
| 4,198,240 | 4/1980 | Mikawa | 430/611 |
| 4,269,927 | 5/1981 | Atwell | 430/503 |
| 4,434,226 | 2/1984 | Wilgus et al. | 430/567 |

*Primary Examiner*—J. Travis Brown

*Attorney, Agent, or Firm*—Frishauf, Holtz, Goodman & Woodward

[57] ABSTRACT

A silver halide photographic emulsion, which comprises (i) a mono-dispersed silver halide emulsion comprising 3 to 50 mole % of silver chloride, 1 mole % or less of silver iodide and 50 to 97 mole % of silver bromide having a grain size distribution of 0.15 or less in terms of the coefficient of variation $S/\bar{r}$ (where S is standard deviation and $\bar{r}$ is mean grain diameter), and (ii) a coupler represented by the following formula:

wherein X represents an organic group which is bonded through an oxygen atom, a nitrogen atom or a sulfur atom to the coupler and is eliminable during the coupling reaction with an oxidized product of a color developing agent; Y represents a halogen atom, an alkoxy group, an aryloxy group, a diacylamino group or an alkyl group; R represents a trifluoromethyl group, an acylamino group, a sulfonamide group, a ureido group, an alkyl group, an alkoxy group, an aryloxy group, an alkoxycarbonyl group, a carbamoyl group, a sulfamoyl group or an imide group, which is bonded to the anilide group at the 4- or 5-position.

14 Claims, 3 Drawing Figures

SILVER HALIDE PHOTOGRAPHIC EMULSION

Figure 1:
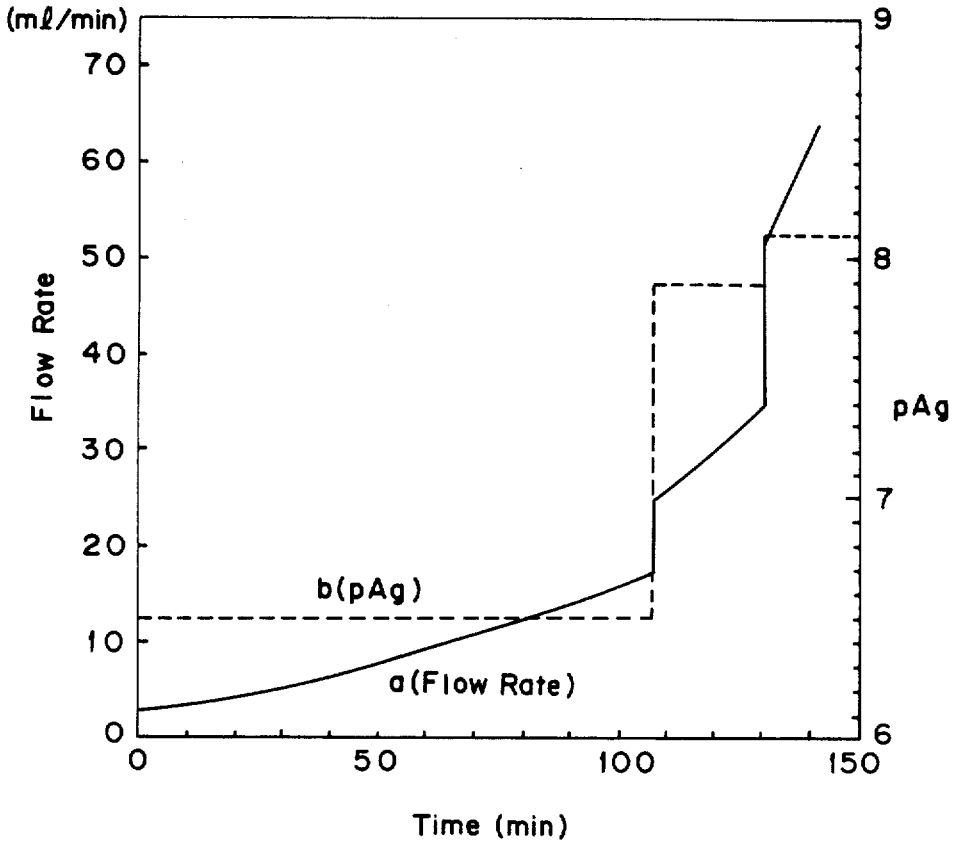

This invention relates to a silver halide photographic emulsion for color photography, improved in stagnant storability.

Silver halide color print papers have a blue-sensitive silver halide emulsion layer containing a yellow coupler color-formed in yellow through the reaction with an oxidized product of a color developing agent, a green-sensitive silver halide emulsion layer containing a magenta coupler color-formed in magenta through the reaction with an oxidized product of a color developing agent and a red-sensitive silver halide emulsion layer containing a cyan coupler color-formed in cyan through the reaction with an oxidized product of a color developing agent, successively laminated on a support.

Each emulsion is prepared according to the step of forming silver halide grains (hereinafter called as the IR) and the step of enhancing sensitivity of the silver halide grains (hereinafter called as the IIR), followed by addition of a coupler to prepare an emulsion.

The time after an emulsion is prepared until it is coated on a support tends to be lengthened as the production scale is expanded (in this invention, the time after an emulsion is prepared before it is coated, during which it exists in state of an emulsion, is called as stagnation time). The photographic characteristics of an emulsion are required to be not changed during stagnation time. However, increase of fog is observed particularly in a blue-sensitive emulsion layer and improvement in this respect has been desired. In the absence of a yellow coupler, such a fog in said blue-sensitive emulsion layer is not increased during stagnation time.

On the other hand, as yellow couplers, there have been employed pivaloyl acetanilide type couplers of which active methylene is substituted with an eliminable group during oxidative coupling with a color developing agent, because they are high in dye density obtained from a unit amount of silver halide applied with the same dosage of exposure, and also because the resultant dyes are good in spectral absorption and fast to light, moisture and heat. These couplers, because of their higher color forming efficiencies, are sensitive to increases in fog during stagnation time and exhibit marked yellow fog.

An object of this invention is to provide an emulsion by use of a pivaloyl acetanilide type coupler of which active methylene group is substituted with an eliminable group during the oxidative coupling with a color developing agent which is prevented from fog increase during stagnation time, and a silver halide color print paper by use of said emulsion.

The object of this invention can be accomplished by a silver halide photographic emulsion, which comprises (i) a mono-dispersed silver halide emulsion comprising 3 mole % or more of silver chloride, 2 mole % or less of silver iodide and 97 mole % or less of silver bromide and has a grain size distribution of 0.15 or less in terms of the coefficient of variation $S/\bar{r}$ (wherein S is standard deviation and $\bar{r}$ is mean grain diameter) concerning the grain sizes of said silver halide grains, and (ii) a coupler represented by the following formula:

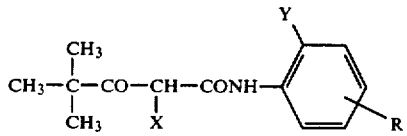

wherein X represents an organic group which is bonded through an oxygen atom, a nitrogen atom or a sulfur atom to the coupler and is eliminable during the coupling reaction with an oxidized product of a color developing agent; Y represents a halogen atom, an alkoxy group, an aryloxy group, a diacylamino group or an alkyl group; R represents a trifluoromethyl group, an acylamino group, a sulfonamide group, a ureido group, an alkyl group, an alkoxy group, an aryloxy group, an alkoxycarbonyl group, a carbamoyl group, a sulfamoyl group or an imide group, which is bonded to the anilide group at the 4- or 5-position.

In a preferred embodiment of this invention, the mono-dispersed silver halide emulsion comprises 3 to 50 mole % of silver chloride, 50 to 97 mole % of silver bromide and 1 mole % or less of silver iodide. Also, said mono-dispersed silver halide emulsion preferably comprises a silver chloride, a silver chlorobromide or a silver chloroiodobromide.

The coefficient of variation $S/\bar{r}$ can be given from the following definitions:

$$\text{Standard deviation } S = \sqrt{\Sigma(\bar{r} - ri)^2 ni/\Sigma ni}$$

$$\text{Mean grain diameter } \bar{r} = \Sigma niri/\Sigma ni.$$

In the above formulae, ri is the grain diameter of the i'th section when the range of the grain diameter distribution is divided into sections in number of m, and ni is the number of grains having the grain diameter ri. The coefficient of variation may sometimes be represented in terms of % by multiplying its value by 100.

This invention will be described below in detail with reference to the accompanying drawings.

Figure 2:
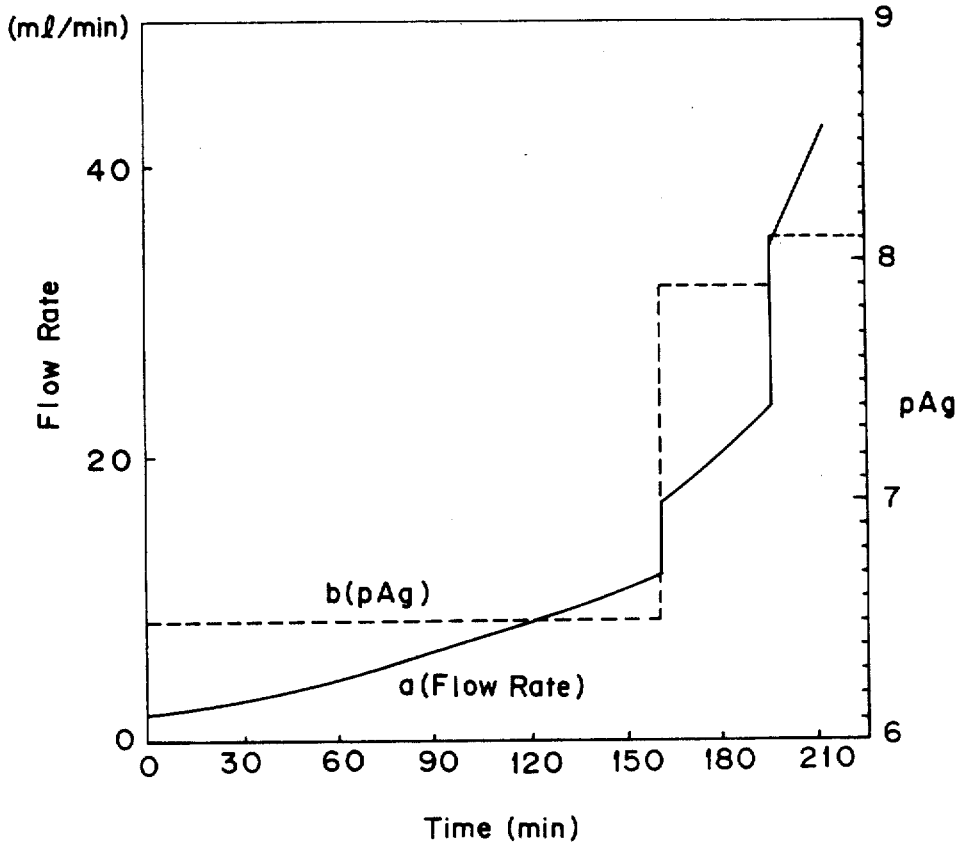
Figure 3:
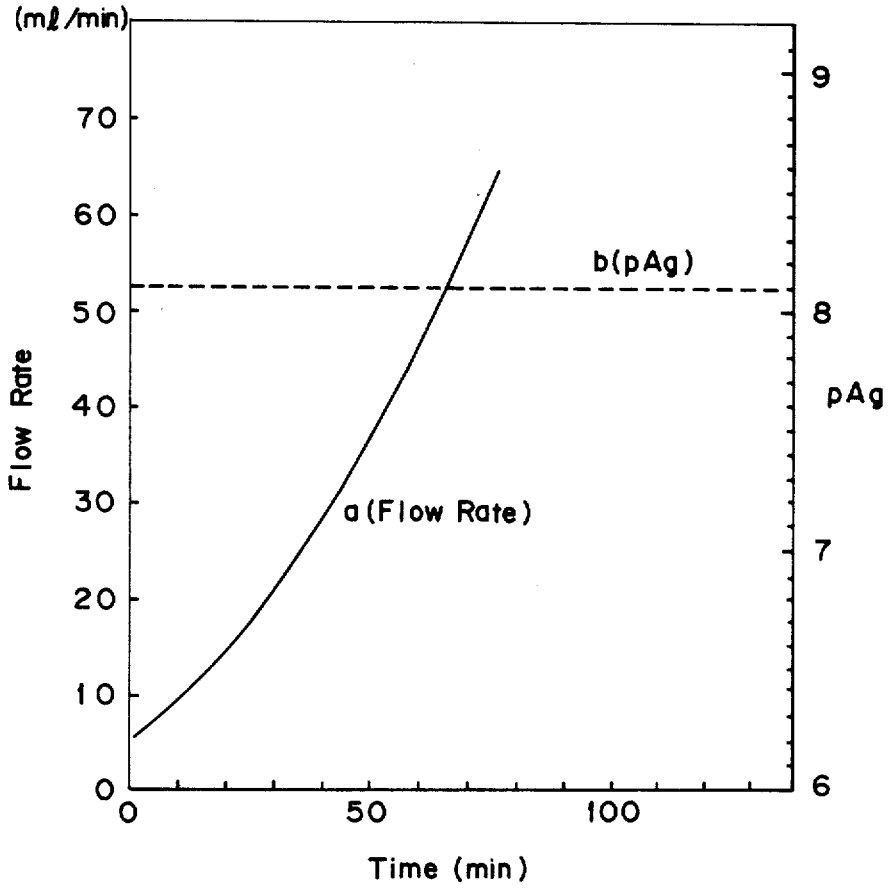

In the drawings;

FIG. 1, FIG. 2 and FIG. 3 each show the curve of the amount of silver ion added (flow rate) and the curve for controlling pAg, in which the left ordinate axis is the flow rate, the right ordinate axis is the pAg value and the abscissa axis is time.

The light-sensitive color photographic material employing the silver halide photographic emulsion is a light-sensitive material for obtaining a posi-image rather than a color film for photography for obtaining a nega-image, and, in view of the advantages of good developing characteristics and hard tone (higher gamma) as well as good silver removal, there may be employed a silver chloride, a silver chlorobromide or a silver chloroiodiobromide, containing 3 mole % or more of silver chloride, 2 mole % or less of silver iodide and 97 mole or less of silver bromide. Accordingly, the emulsion according to this invention contains none of silver iodobromide and silver chloroiodobromide containing silver iodide in excess of 2 mole % which have been known to be useful in other photographic technology.

The object of this invention has been accomplished by use of an emulsion containing a coupler represented by the above formula (I), in which the silver halide grains have a narrow grain size distribution. It has never been pointed out in the prior art about the relationship between the fog generated during stagnation time and the grain size distribution of the silver halide grains. It may be estimated to be due to the effect of IIR upon individual grains, which IIR seems to proceed more uniformly and at equal speeds as the grain size distribution is narrower. But no such effect can be attained unless the grain size distribution is made markedly narrow. That is, it is an effect, which has not been found until preparation of a mono-dispersed emulsion satisfying the above-mentioned relation of the coefficient of variation $S\bar{r} \leqq 0.15$ is rendered possible according to the method for preparation of the mono-dispersed emulsion as described below. The effects of the invention will be also attained when two or more kinds of mono-dispersed emulsions are subjected separately to IIR and mixed together. Therefore, it is possible to use two more kinds of mono-dispersed emulsions as a mixture.

The silver halide grains may have irregular shapes such as spherical shapes or regular shapes such as cubic, octahedral or tetradecahedral shapes.

For preparation of the mono-dispersed emulsion according to thie invention as described above, there may be preferably employed the controlled double jet method, in which silver ions and halide ions are added at the same time, while controlling pH and pAg in a reactor. Said method is disclosed in, for example, Japanese Provisional Patent Publication No. 48521/1979; Japanese Patent Application (7) entitled "Silver halide photographic emulsion and preparation thereof", filed on Sept. 8, 1982; and Japanese Patent Application (1) entitled "Silver halide photographic emulsion and preparation thereof", filed on Sept. 9, 1982.

The mean grain diameter $\bar{r}$ may fall within the range from $0.5\mu$ to $2\mu$, more preferably from $0.1\mu$ to $1\mu$.

The emulsion of this invention can suppress increase of fog during stagnation time and at the same time makes it possible to design a light-sensitive material with a low silver content.

Namely, the coupler to be used in the present invention has a high reactivity with an oxidized product of a color developing agent, and the level of the silver halide can be lowered by 5 to 10% in order to obtain the same maximum density. However, on reduction of silver halide content, the $\gamma$ (gamma) becomes smaller so that the light-sensitive material no longer useful for obtaining a posi-image from a nega-image of a color film for photographing. It can easily be expected that $\gamma$ can be made greater by making smaller the grain size distribution of the silver halide emulsion. In case of a silver iodobromide, $\gamma$ can be increased than in a poly-dispersed emulsion ($S/\bar{r} > 0.25$) by making the above coefficient of variation $S/\bar{r}$ = ca. 0.2. Nevertheless, in case of silver chloride, silver chlorobromide or silver chloroiodobromide emulsion containing 2 mole % of silver iodide, $\gamma$ cannot become sufficiently large with such an extent of modification toward mono-dispersion. Whereas, when there is employed an emulsion of this invention satisfying $S/r \leqq 0.15$, $\gamma$ can be increased markedly larger, whereby the resultant light-sensitive material is sufficiently useful as a low silver content light-sensitive material for obtaining a posi-image from a nega-image obtained from a color film for photographing.

The mono-dispersed emulsion of this invention may also permit, during the procedure of IR, a cadmium salt, a zinc salt, a lead salt, a thallium salt, an iridium salt or a complex salt thereof, a rhodium salt or a complex salt thereof, an iron salt or a complex salt thereof to co-exist therein.

The photographic emulsion of this invention may be spectrally sensitized with methyne dyes or others. Useful dyes may include cyanine dyes, melocyanine dyes, complex cyanine dyes, complex melocyanine dyes, homo-polar cyanine dyes, hemicyanine dyes, styryl dyes and hemioxonol dyes. Particularly useful dyes are those belonging to cyanine dyes melocyanine dyes and complex melocyanine dyes. For these dyes, any nucleus conventionally utilized as a basic heterocyclilc nucleus for cyanine dyes may be applicable. That is, there are pyrolilne nucleus, oxazoline nucleus, thiazoline nucleus, pyrole nucleus, oxazole nucleus, thiazole nucleus, selenazole nucleus, imidazole nucleus, tetrazole nucleus, pyridine nucleus, and so on. Also applicable are nuclei having alicyclic hydrocarbon rings fused to these nuclei and having aromatic hydrocarbon rings fused to these nuclei, as exemplified by indolenine nucleus, benzoindolenine nucleus, indole nucleus, benzooxazole nucleus, napththooxazle nucleus, benzothiazole nucleus, naphthothiazole nucleus, benzoselenaole nucleus, benzoimidazole nucleus, quinoline nucleus, and others. These nuclei may be substituted on the carbon atoms.

Melocyanine dyes or complex melocyanine dyes are applicable which have a nucleus a ketomethylene structure, 5- to 6-membered heterocyclic nucleus, such as pyrazoline-5-one nucleus, thiohydanthoine nucleus, 2-thiooxazolidine-2,4-dione nucleus, thiazolidine-2,4-dione nucleus, rhodanine nucleus, thiobarbituric acid nucleus and others. Useful sensitizing dyes are those disclosed in, for example, German Pat. No. 929,080; U.S. Pat. Nos. 2,2,31,658; 2,493,748; 2,503,776; 2,519,001; 2,912,329; 3,655,394; 3,656,959; 3,672,897; 3,694,217; U.K. Patent No. 1,242,588; and Japanese Patent Publication No. 14030/1969.

These sensitizing dyes may also be used individually, but their combination are also useful. Indeed, combined sensitizing dyes are frequently used particularly for the purpose of sensitization of strong colors. Typical examples are disclosed in U.S. Pat. Nos. 2,688,545; 2,977,229, 3,397,060; 3,522,052; 3,527,641; 3,617,293; 3,628,964; 3,666,480; 3,679,428; 3,703,377; 3,769,301; 3,814,609; 3,837,862; U.K. Patent No. 1,344,281; and Japanese Patent Publication No. 4936/1968.

It is also possible to incorporate in the emulsion a substance which is a dye having itself no spectral sensitizing action or a substance capable of absorbing substantially no visible light, but can exhibit a strong color sensitization. For example, there may be included aminostilbene compounds (as disclosed in U.S. Pat. Nos. 2,933,390 and 3,635,721), aromatic organic acid formaldehyde condensates (as disclosed in U.S. Pat. No. 3,743,510), cadmium salt, azaindene compounds and others. Particularly useful are combinations as disclosed in U.S. Pat. Nos. 3,615,613; 3,615,641; 3,617,295; and 3,635,721.

The photographic emulsion of this invention may also contain, for the purpose of elevating sensitivity and gamma or accelerating development, for example, polyalkylene oxides or derivatives thereof such as ethers, esters, amines, etc.; thioether compounds; thiomorpholine compounds; quaternary ammonium salt compounds; urethane derivatives; urea derivatives; imidazole derivatives; and 3-pyrazolidones. Illustrative are those as disclosed in U.S. Pat. Nos. 2,400,532; 2,423,549; 2,716,062; 3,617,280; 3,772,021; and 3,808,003. The photographic emulsion of this invention can also contain an antifoggant or a stabilizer. Typical compounds having such functions are disclosed in Product Licensing Index Vol. 92, page 107, "Antifoggant and Stabilizer".

Further, the silver halide to be used in this invention can be dispersed in a colloid which can be hardened with various organic or inorganic film hardeners (generally gelatin). As the film hardeners, hardeners disclosed in the above Index, Vol. 92, page 108 "Hardener" may be employed.

The photographic emulsion of this invention can contain a coating aid. As such coating aids, those disclosed in "Coating Aid" on page 108, in the above Index, Vol. 92, may be used.

The color light-sensitive material according to this invention must contain couplers. And, these couplers are generally incorporated in the light-sensitive layer comprising silver halide emulsions in the color light-sensitive material.

In order for these couplers to be incorporated in the photographic emulsion of this invention, when said couplers are alkali soluble, they may be added as alkaline solutions; when they are oil soluble, they may be preferably dissolved in a high boiling solvent, optionally together with a low boiling solvent, and dispersed as minute particles in silver halide emulsions, as described in U.S. Pat. Nos. 2,322,027; 2,801,170; 2,801,171; 2,272,191 and 2,304,940. If desired, during this operation, other hydroquinone derivatives, UV-ray absorbers or antifading agents may also be used in combination. Also, two or more kinds of couplers may be used as a mixture. To describe in further detail about the preferable method for adding couplers, one kind or two or more kinds of couplers, optionally together with other couplers, hydroquinone derivatives, antifading agents or UV-ray absorbers, are dissolved in a high boiling solvent, as exemplified by organic acid amides, carbamates, esters, ketones, urea derivatives, specifically d-n-butyl phthalate, tricresyl phosphate, triphenyl phosphate, di-isooctyl azelate, di-n-butyl sebacate, tri-n-hexyl phosphate, N,N-di-ethylcaprylamide butyl, N,N-diethyllaurylamide, N-pentadecylphenyl ether, di-octylphthalate, n-nonylphenol, 3-pentadecylphenyl ethyl ether, 2,5-di-sec-amylphenyl butyl ether, monophenyl-o-chlorophenyl phosphate or fluorinated paraffines and/or a low boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl alcohol, acetonitrile, dimethylformamide, dioxane, methyl ethyl ketone and so on, and the resultant solution is mixed with a solution containing an anionic surfactant such as alkylbenzenesulfonic acid and or a nonionic surfactant such as sorbitane sesqui-oleic acid ester and sorbitane monolauric acid ester and/or a hydrophilic binder such as gelatin, followed by emulsification by means of a high speed rotary mixer, colloid mill or a sonication dispersing means, and thereafter the resultant emulsion is added to the silver halide emulsion.

The couplers may also be dispersed by use of the latex dispersing method. The latex dispersing method and its effect are well described in, for example, Japanese Provisional Patent Publication No. 74538/1974, No. 59943/1976 and No. 32552/1979, and Research Disclosure No. 14850, pp. 77-79, August, 1976.

Suitable latices are those of, for example, homopolymers, copolymers and terpolymers of monomers such as styrene, ethyl acrylate, n-butyl acrylate, n-butyl methacrylate, 2-acetoaceoxyethyl methacrylate, 2-(methacryloyloxy)-ethyltrimethylammonium methosulfate, sodium 3-(methacryloyloxy)propane-1-sulfonate, N-isopropylacrylMide, N-[2-(2-methyl-4-oxopentyl)]acrylamide, 2-acrylamide-2-methylpropane sulfonic acid and the like.

The amount of the coupler added is not limited but preferably 10 to 100 g per mole of silver halide.

In the photographic emulsion of this invention, it is advantageous to use as a UV-ray absorber a thiazolidone, benzotriazole, acrylonitrile or benzophenone type compound for the purpose of prevention of fading of the dye by active rays with short wavelengths. In particular, Tinuvin ps, 320, 326, 327 and 328 (each produced by Ciba-Geigy Co.) may be advantageously used either singly or as a combination.

The hydroquinone derivatives to be used together with the above-mentioned couplers in the photographic emulsion of this invention are also inclusive of the precursors thereof. The precursors mentioned herein mean the compounds capable of liberating hydroquinone derivatives through hydrolysis.

Preferable examples of the above-mentioned antifading agents are curomane type compounds, cumarane type compound and spirocuromane type compounds.

The coupler to be used in this invention is represented by the following formula (I):

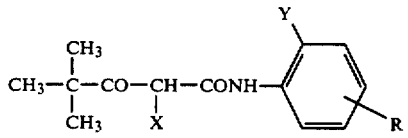

wherein X represents an organic group which is bonded through an oxygen atom, a nitrogen atom or a sulfur atom to the coupler and is eliminable during the coupling reaction with an oxidized product of a color developing agent; Y represents a halogen atom, an alkoxy group, an aryloxy group, a diacylamino group or an alkyl group; R represents a trifluoromethyl group, an acylamino group, a sulfonamide group, a ureido group, an alkyl group, an alkoxy group, an aryloxy group, an alkoxycarbonyl group, a carbamoyl group, a sulfamoyl group or an imide group, which is bonded to the anilide group at the 4- or 5-position.

Exemplary of said couplers are those enumerated below.

[Exemplary couplers]

[Y-1]

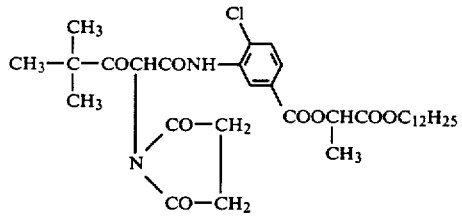

[Y-2]

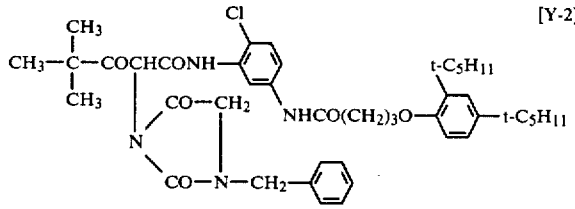

-continued
[Exemplary couplers]
[Y-3]
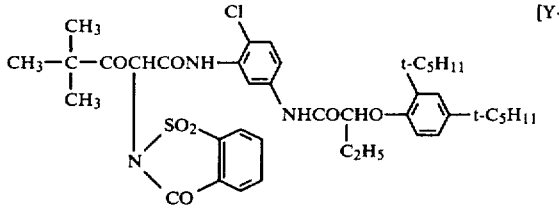
[Y-4]
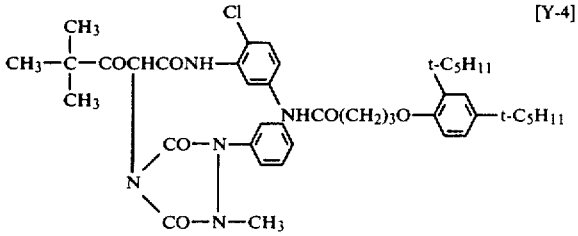
[Y-5]
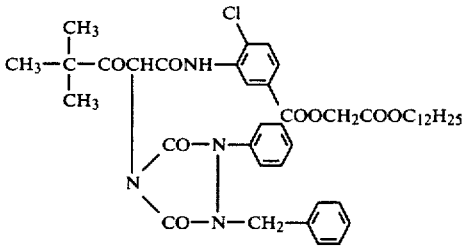
[Y-6]
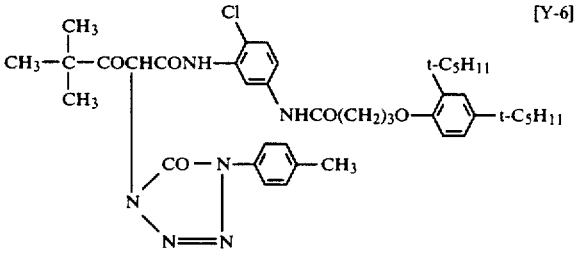
[Y-7]
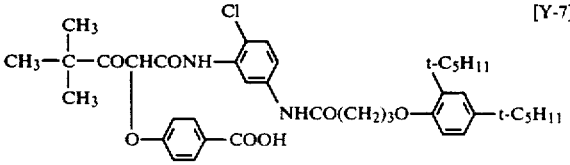
[Y-8]
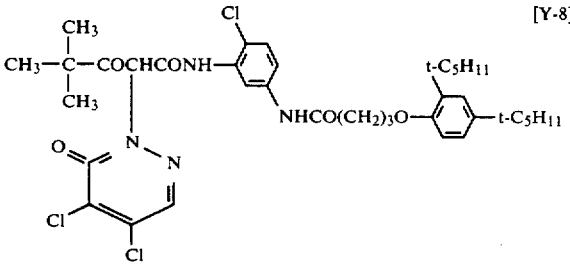
-continued
[Exemplary couplers]
[Y-9]
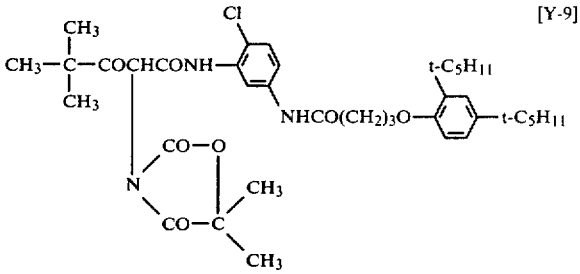
[Y-10]
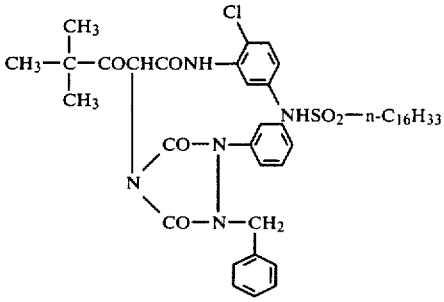
[Y-11]
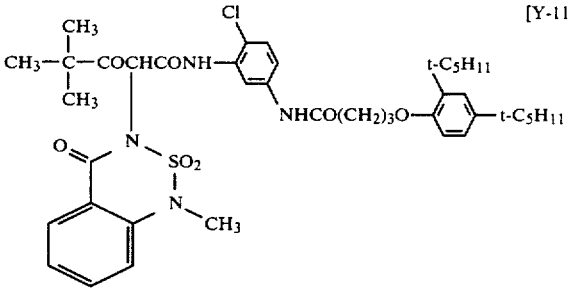
[Y-12]
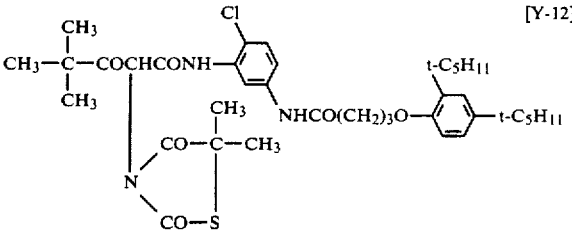
[Y-13]
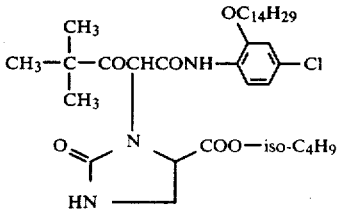
[Y-14]
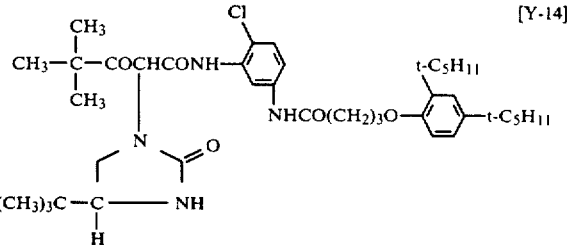

-continued

[Exemplary couplers]

[Y-15]

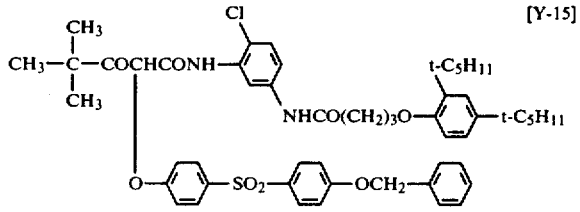

[Y-16]

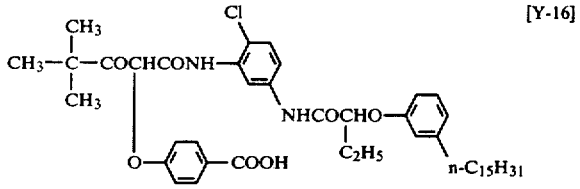

[Y-17]

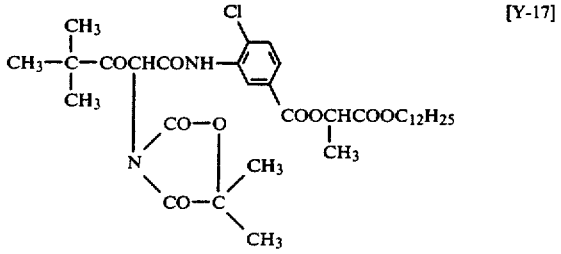

[Y-18]

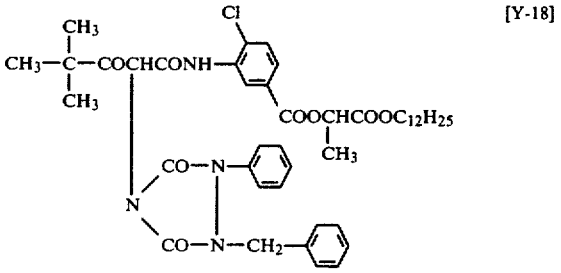

[Y-19]

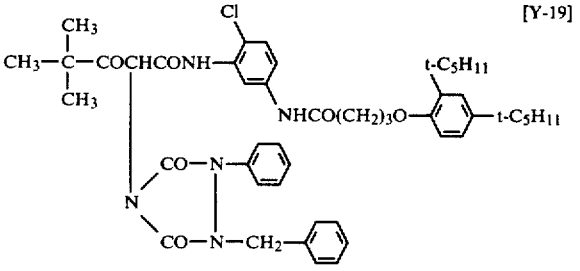

[Y-20]

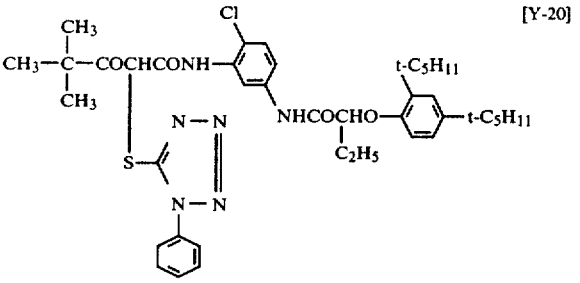

The light-sensitive photographic material using the photographic emulsion of this invention may also contain dyes as filter dyes or for other various purposes such as irradiation prevention, etc. in the photographic emulsion layer or other hydrophilic colloidal layers. Such dyes are disclosed in the above Index, Vol. 92, page 109 "Absorbing and Filter Dyes".

The light-sensitive photographic material using the photographic emulsion of this invention may also contain antistatic agents, plasticizers, matting agents, wetting agents, UV-ray absorbers, fluorescencent whitening agents, anti-air-foggant, etc.

In the photographic emulsion of this invention, there may be employed vehicles disclosed in the above Index Vol. 92, page 108 "Vehicles".

As the vehicle in the photographic emulsion of this invention, gelatin as well as other various hydrophilic colloids may be employed. As the gelatin to be used as the vehicle, not only gelatin but also gelatin derivatives are included. Gelatin derivatives may include the reaction products of gelatin with acid anhydrides, the reaction products of gelatin with isocyanates or the reaction products of gelatin with compounds having active halogen atoms.

As the various hydrophilic colloids, there may be included in addition to the above-mentioned gelatin derivatives, if necessary, colloidal alubumin, agar, gum arabic, dextran, alginic acid, cellulose derivatives such as those hydrolyzed to an acetyl content of 19 to 26%, polyacrylamide, imidated polyacrylamide, casein, vinyl alcohol polymers containing urethane carboxylic groups or cyanoacetyl groups such as vinyl alcohol-vinyl cyanoacetate copolymer, polyvinyl alcohol-polyvinyl pyrrolidone, hydrolyzed polyvinyl acetate, polymers obtained by polymerization of proteins or saturated acylated proteins and monomers having vinyl groups, polyvinyl pyridine, polyvinylamine, polyaminoethyl methacrylate, polyethyleneimine and so on.

The photographic emulsion of this invention may be coated on a support together with another photographic layer, if desired. As the coating method, there may be employed the methods disclosed in the above Index, Vol. 92, page 109, "Coating Procedures". As for the support, those disclosed in the above Index, Vol. 92, page 108, "Support" may be used.

The light-sensitive color photographic materials using the photographic emulsion of this invention may be employed for obtaining posi-images from color films for photographing. Particularly, they are useful advantageously as color papers.

Exposure of the photographic images with the use of the light-sensitive material using the photographic emulsion of this invention may be conducted in a conventional manner. That is, all of the light sources known in the art may be available, including natural light, tungsten lamp, fluorescent lamp, mercury lamp, xenon arc lamp, carbon arc lamp, xenon flasm lamp, cathode-ray tube flying spot, etc. The exposure time may be of course such an order of 1/1000 sec. to 1 sec. as usually employed in cameras, but also a short time exposure on the order of $1/10^6$ to $1/10^9$ sec. as by use of a xenone flash lamp or a cathode-ray tube. Also, an exposure longer than one second may also be possible. If necessary, the spectroscopic composition of the light employed for exposure may be controlled by means of a color filter. A laser beam may also be available for exposure, or alternatively exposure may be effected by a light emitted from an emitter excited by electron beams, X-ray, $\gamma$-ray or $\alpha$-ray.

This invention is further illustrated by referring to the following Examples, by which this invention is not limited.

EXAMPLE 1

By use of the seven kinds of solutions shown below, silver chlorobromide seed emulsions were prepared containing 90 mole % of silver bromide content.

| | |
|---|---|
| [Solution 1-A] | |
| Ossein gelatin | 40 g |
| Distilled water | 4000 ml |
| 10% Ethanolic aqueous solution of polyisoprene-polyethyleneoxydisuccinic acid sodium salt | 10 ml |
| $AgNO_3$ | 170 mg |
| 10% $H_2SO_4$ | 35 ml |
| [Solution 1-B] | |
| $AgNO_3$ | 23 g |
| Distilled water | make up to 1350 ml |
| [Solution 1-C] | |
| $AgNO_3$ | 577 g |
| Distilled water | make up to 1700 ml |
| [Solution 1-D] | |
| Ossein gelatin | 27 g |
| KBr | 15.11 g |
| NaCl | 0.783 g |
| 10% Ethanolic aqueous solution of polyisoprene-polyethyleneoxydisuccinic acid sodium salt | 5 ml |
| 10% $H_2SO_4$ | 19 ml |
| Distilled water | make up to 1340 ml |
| [Solution 1-E] | |
| Ossein gelatin | 33 g |
| KBr | 371 g |
| NaCl | 19.87 g |
| 10% Ethanolic aqueous solution of polyisoprene-polyethyleneoxydisuccinic acid sodium salt | 6 ml |
| 10% $H_2SO_4$ | 18.5 ml |
| Distilled water | make up to 1700 ml |
| [Solution 1-F] | |
| KBr | 8.26 g |
| NaCl | 112.8 g |
| Distilled water | make up to 2000 ml |
| (Solution 1-G] | |
| 7% Aqueous sodium carbonate solution | 208 ml |

At 40° C., by means of a stirring mixer as disclosed in Japanese Unexamined Publications Nos. 92523/1982 and 92524/1982, Solution 1-B and Solution 1-D were added to Solution 1-A over an addition time of 29.5 minutes according to the double jet method. The addition rates were increased with the addition time in a zig-zag pattern as shown in Table 1. Two minutes after completion of addition, Solution 1-C and Solution 1-E were added according to the double jet method over an addition time of 83 minutes.

TABLE 1

| | Addition rate [ml/min.] | | | |
|---|---|---|---|---|
| Time (min.) | Soln. 1-B | Soln. 1-D | Soln. 1-C | Soln. 1-E |
| 0 | 10 | 9.7 | — | — |
| 3 | 10 | 9.7 | — | — |
| 5 | 15.9 | 15.4 | — | — |
| 7 | 22.7 | 22.0 | — | — |
| 10 | 36.4 | 35.3 | — | — |
| 12.5 | 50 | 48.5 | — | — |
| 15 | 63.6 | 61.7 | — | — |
| 29.5 | 63.6 | 61.7 | — | — |
| 31.5 | — | — | 3.64 | 3.56 |
| 40 | — | — | 5.45 | 5.35 |
| 50 | — | — | 8.91 | 8.73 |
| 60 | — | — | 12.7 | 12.5 |
| 70 | — | — | 16.8 | 16.5 |

TABLE 1-continued

| | Addition rate [ml/min.] | | | |
|---|---|---|---|---|
| Time (min.) | Soln. 1-B | Soln. 1-D | Soln. 1-C | Soln. 1-E |
| 80 | — | — | 22.3 | 21.8 |
| 90 | — | — | 28 | 27.4 |
| 100 | — | — | 34.5 | 33.9 |
| 114.5 | — | — | 45 | 44.1 |

The addition rates were increased with lapse of time as shown in Table 1. During addition of Solution 1-B and Solution 1-O, and of Solution Solution 1-C and Solution 1-E, the pAg value in solution 1-A was controlled to 4.0 (EAg value +340 mV) by use of Solution 1-F. Measurement of EAg value was conducted by use of a metallic silver electrode and a double-junction type saturated A/AgCl reference electrode. For addition of Solution 1-B, Solution 1-C, Solution 1-D, Solution 1-E and Solution 1-B, a flow rate variable type roller tube metering pump was employed. Three minutes after completion of addition of Solution 1-C and Solution 1-E, EAg value was adjusted to +70 mV by addition of Solution 1-F. Further, 2 minutes later, Solution 1-G was added.

Next, according to the following procedures, washing with water and desalting were conducted. As precipitating agents, 650 ml of an aqueous 5% solution of Demol N produced by Kao-Atlas Co. and 650 ml of an aqueous 20% magnesium sulfate were added to form principitates, which were left to stand to be sedimented. After decantation of the supernatant, 7000 ml of distilled water was added to redisperse the precipitates. Again precipitates were formed by addition of 200 ml of an aqueous 20% magnesium sulfate solution. After sedimentation of the precipitates, the supernatant was decanted and 500 ml of an aqueous ossein gelatin solution (containing 50 g of ossein gelatin) was added to the precipitates, followed by stirring at 55° C. for 30 minutes to effect dispersion, and then the total quantity was made up to 2500 ml with distilled water. This emulsion is hereinafter called as "EM-1". This emulsion was found by electron microscope photograph to be a highly mono-dispersed emulsion consisting of cubic grains with a side length of 0.144 μm, with the standard deviation of the grain sizes being 6.8% of the mean grain diameter.

EXAMPLE 2

By use of the four kinds of solutions shown below, the above EM-1 (seed emulsion) was grown to prepare mono-dispersed emulsions of this invention (EM-1 & EM-2).

| | |
|---|---|
| [Solution 2-A] | |
| Ossein gelatin | 60.2 g |
| Distilled water | 6314 ml |
| 10% Ethanolic aqueous solution of polyisoprene-polyethyleneoxydisuccinic acid sodium salt | 6.5 ml |
| EM-1 (seed emulsion) | 118.9 ml |
| [Solution 2-B] | |
| $AgNO_3$ | 1171.3 g |
| Distilled water | make up to 2298.1 ml |
| [Solution 2-C] | |
| Ossein gelatin | 45.96 g |
| KBr | 777.2 g |
| NaCl | 40.3 g |
| 10% Ethanolic aqueous solution of polyisoprene-polyethyleneoxydisuccinic acid sodium salt | 4.60 ml |

-continued

| | |
|---|---|
| Distilled water | make up to 2298.1 ml |
| [Solution 2-D] | |
| KBr | 12.47 g |
| NaCl | 110.8 g |
| Distilled water | make up to 2000 ml |

At 60° C., by means of a stirring mixer as disclosed in Japanese Unexamined Publications Nos. 92523/1982 and 92524/1982, Solution 2-B and Solution 2-C were added to Solution 2-A over an addition time of 143.6 minutes according to the double jet method. The addition rates were increased with the addition time as shown by the non-continuous curve a in FIG. 1. The addition rate of Solution 2-C was controlled to 0.95-fold of that of Solution 2-B at each point. During addition of each solution, PAg value was controlled so as to be maintained at the set value. PAg values were measured similarly as in Example 1. The set values of PAg were varied stepwise with time as shown by the zig-zag line b in FIG. 1.

Solution 2-B, Solution 2-C and Solution 2-D were added by means of a flow rate variable type roller tube pump.

After completion of addition of Solution 2-B and 2-C, washing with water and desalting were conducted according to the following procedures. As precipitating agents, 1300 ml of an aqueous 5% solution of Demol N produced by Kao-Atlas Co. and 1300 ml of an aqueous 20% magnesium sulfate were added to form pricipitates, which were left to stand to be sedimented. After decantation of the supernatant, 12300 ml of distilled water was added to redisperse the precipitates. Again precipitates were formed by addition of 400 ml of an aqueous 20% magnesium sulfate solution. After sedimentation of the precipitates, the supernatant was decanted and 800 ml of an aquoeus ossein gelatin solution (containing 80 g of ossein gelatin) was added to the precipitates, followed by stirring at 40° C. for 20 minutes to effect dispersion, and then the total quantity was made up to 5000 ml with distilled water. This emulsion is hereinafter called "EM-2".

Also prepared was a mono-dispersed emulsion in the same manner as in the preparation of the emulsion EM-2 except that the addition rate of Solution 2-B and PAg value were varied as shown in FIG. 2. This emulsion is hereinafter called as "EM-3".

COMPARATIVE EXAMPLE 1

As a Comparative emulsion, a poly-dispersed silver chlorobromide emulsion was prepared according to the same procedure as in Example 2, in which Solution 2-C was added correspondingly to addition of Solution 2-B and PAg was contolled by Solution 2-D, except that the setting value of PAg was set at a certan value (pAg=8.1) and the addition rate of Solution 2-B was changed as according to the curve a in FIG. 3. This emulsion is hereinafter called as "EM-4".

The silver halide micro-crystals contained in the emulsions EM-1 to EM-4 were examined for their crystal forms and grain size distribution from electron microscope photographs. The grain sizes measured for cubic crystals were side lengths, while those for tetradecahedral and octahedral crystals were sizes in certain directions. The results are shown in Table 2.

TABLE 2

| Emulsion | Shape | Average grain size | Distribution (coefficient of variation %) |
|---|---|---|---|
| EM-1 (seed emulsion) | Cubic | 0.144 μm | 6.8% |
| EM-2 (this invention) | Octa-hedral | 0.591 μm | 8.4% |
| EM-3 (this invention) | Octa-hedral | 0.591 μm | 14.5% |
| EM-4 (Control) | Tetradeca- to octa-hedral, irregular | 0.673 μm | 18.1% |

EXAMPLE 3

Each of EM-2 and EM-3 was applied to the optimum chemical sensitization by adding 0.353 mol of sodium thiosulfate thereto. Next, separately, 103 g of yellow couplers (Compounds A, B and C shown below) were each dissolved in a mixture of 62 g of dioctylphthalate and 150 ml of ethyl acetate under heating at 60° C., and the resultant solution was added to 1000 ml of an aqueous solution of 40° C. containing 60 g of gelatin and 5.1 g of sodium dodecylbenzenesulfonate, followed by vigorous agitation by a homogenizer to effect dispersion, and the whole dispersion was made up to 1500 ml with water to prepare each emulsified dispersion of the coupler.

Each of the emulsions applied with chemical sensitization was divided into three portions, and (a) immediately after ripening, 500 ml of the above coupler emulsion was mixed with a divided portion of the emulsion, admixed with a film hardener of 20 ml of a 3% methanolic solution of 1,3,5-triacryloyl-hexahydro-s-triazine, and then coated on a polyethylene resin coated paper, followed by addition of the above dispersion of A, B and C, to prepare Samples 2Aa, 2Ba and 2Ca (by use of EM-2), Samples 3Aa, 3Ba and 3Ca (by use of EM-3), and Samples 4Aa, 4Ba and 4Ca (by use of EM-4), (Condition a);

(b) after ripening, a divided portion was stirred at 40° C. for 10 hours, and coated with addition of the coupler dispersion and the film hardner as in the above (a) to prepare Samples 2Ab, 2Bb and 2Cb (EM-2), Samples 3Ab, 3Bb and 3Cb (EM-3), and Samples 4Ab, 4Bb and 4Cb (EM-4), (Condition b);

(c) after ripening, the above coupler dispersion was added to a divided portion, and the mixture was stired at 40° C. for 10 hours, followed by coating with addition of the hardener to prepare Samples 2Ac, 2Bc and 2Cc (EM-2), Samples 3Ac, 3Bc and 3Cc (EM-3), and Samples 4Ac, 4Bc and 4Cc (EM-4), (Condition c).

Exemplary coupler [Y-19] Compound A

Compound B

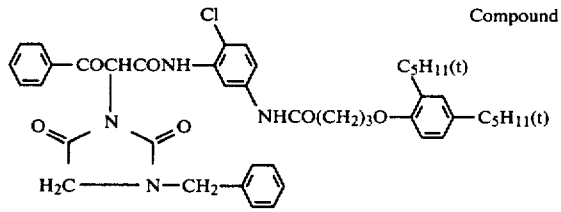

-continued

Compound C

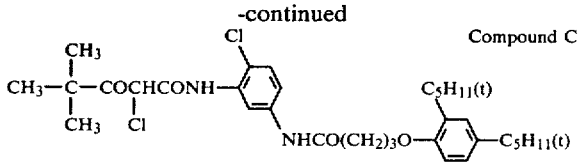

The above samples were each exposed to blue light through an optical wedge, and then subjected to the processings shown below, followed by measurements.

| [Processing step] | [Temperature] | [Time] |
|---|---|---|
| Color developing | 30° C. | 6 min. |
| Stopping | 30° C. | 1 min. |
| Fixing | 30° C. | 2 min. |
| Washing with water | 30° C. | 2 min. |
| Bleach-fixing | 30° C. | 2 min. |
| Washing with water | 30° C. | 2 min. |
| (Composition of color developer) | | |
| Anhydrous sodium carbonate | | 2.6 g |
| Anhydrous sodium bicarbonate | | 3.5 g |
| Potassium sulfite | | 18 g |
| Sodium chloride | | 0.2 g |
| Potassium bromide | | 1.3 g |
| Potassium hydroxide | | 0.4 g |
| Hydroxyammonium sulfate | | 2 g |
| 4-Amino-3-methyl-N—ethyl-N—(β-methanesulfonamidoethyl)-aniline | | 5 g |
| Make up to one liter with water (pH 10.2) | | |
| (Stopping solution) | | |
| 2% Aqueous acetic acid | | |
| (Fixing solution) | | |
| Ammonium thiosulfate | | 175.0 g |
| Anhydrous sodium sulfite | | 8.6 g |
| Metasodium sulfite | | 2.3 g |
| Make up to one liter, and adjusted to pH 6.0 with acetic acid | | |
| (Bleach-fixing solution) | | |
| Ammonium thiosulfate | | 100 g |
| Potassium sulfite | | 5 g |
| Na[Fe(EDTA)] | | 40 g |
| EDTA | | 4 g |
| Make up to one liter with water | | |

The results of measurements are shown in Table 3. As can be seen from Table 3, the mono-dispersed emulsion of this invention is excellent in stagnation storability in a coating solution containing a coupler dispersion and suitable for commercial production, as compared with the poly-dispersed emulsion of the prior art.

TABLE 3

| Characteristics | Coupler: | Emulsion (C.V.)*1 EM-2 (8.4%) A | B | C | EM-3 (14.5%) A | B | C | EM-4 (18.1%) A | B | C |
|---|---|---|---|---|---|---|---|---|---|---|
| Sensitivity*2: | Condition | | | | | | | | | |
| | a | 100 | 100 | 100 | 100 | 100 | 100 | 100 | 100 | 100 |
| | b | 103 | 97 | 101 | 100 | 98 | 98 | 99 | 98 | 99 |
| | c | 98 | 90 | 93 | 98 | 87 | 90 | 110 | 89 | 91 |
| Fog*3: | a | 0.02 | 0.15 | 0.08 | 0.02 | 0.15 | 0.08 | 0.02 | 0.15 | 0.09 |
| | b | 0.02 | 0.16 | 0.10 | 0.02 | 0.15 | 0.08 | 0.02 | 0.17 | 0.10 |
| | c | 0.03 | 0.31 | 0.20 | 0.05 | 0.33 | 0.24 | 0.11 | 0.35 | 0.23 |

*1coefficient of variation represented in %
*2measured with blue color reflected density, in the series of conditions a, b and c, the value of a was made 100
*3blue color reflected density

We claim:

1. A silver halide photographic emulsion, which comprises (i) a mono-dispersed silver halide emulsion comprising 3 to 50 mole % of silver chloride, 1 mole % or less of silver iodide and 50 to 97 mole % of silver bromide having a grain size distribution of 0.15 or less in terms of the coefficient of variation $S/\bar{r}$ (where S is standard deviation and $\bar{r}$ is mean grain diameter), and (ii) a coupler represented by the following formula:

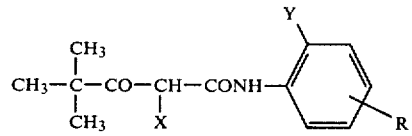

wherein X represents an organic group which is bonded through an oxygen atom, a nitrogen atom or a sulfur atom to the coupler and is eliminable during the coupling reaction with an oxidized product of a color developing agent; Y represents a halogen atom, an alkoxy group, an aryloxy group, a diacylamino group or an alkyl group; R represents a trifluoromethyl group, an acylamino group, a sulfonamide group, a ureido group, an alkyl group, an alkoxy group, an aryloxy group, an alkoxycarbonyl group, a carbamoyl group, a sulfamoyl group or an imide group, which is bonded to the anilide group at the 4- or 5-position.

2. The silver halide photographic emulsion according to claim 1, wherein said mono-dispersed silver halide emulsion comprises silver chloride, a silver chlorobromide or a silver chloroiodobromide.

3. The silver halide photographic emulsion according to claim 1, wherein said mono-dispersed silver halide emulsion has a grain size distribution of 0.10 or less in terms of the variation coefficient $S/\bar{r}$.

4. The silver halide photographic emulsion according to claim 1, wherein said mono-dispersed silver halide emulsion consists of silver chlorobromide containing 3 to 50 mole % of silver chloride and 50 to 97 mole % or less of silver bromide.

5. The silver halide photographic emulsion according to claim 1, wherein said mono-dispersed silver halide emulsion has a mean grain size diameter within the range of from 0.05 to 2μ.

6. The silver halide photographic emulsion according to claim 1, wherein the emulsion consists essentially of said mono-dispersed silver halide emulsion as the silver halide emulsion (1).

7. The silver halide photographic emulsion according to claim 1, wherein X represents a 5-membered heterocyclic group which is directly bonded with a nitrogen atom to the coupler.

8. The silver halide photographic emulsion according to claim 1, wherein Y represents a halogen atom.

9. The silver halide photographic emulsion according to claim 1, wherein R represents an acylamino group.

10. The silver halide photographic emulsion according to claim 6, wherein said mono-dispersed silver halide emulsion has a mean grain size diameter within the range of from 0.05 to 2μ.

11. The silver halide photographic emulsion according to claim 10, wherein X represents a 5-membered heterocyclic group which is directly bonded with a nitrogen atom to the coupler, Y represents a halogen atom and R represents an acylamino group.

12. The silver halide photographic emulsion according to claim 11, wherein said mono-dispersed silver halide emulsion has a grain size distribution of 0.10 or less in terms of the variation coefficient $S/\bar{r}$.

13. The silver halide photographic emulsion according to claim 12, wherein said mono-dispersed silver halide emulsion consists of silver chlorobromide containing 3 to 50 mole % of silver chloride and 50 to 97 mole % or less of silver bromide.

14. The silver halide photographic emulsion according to claim 13, wherein said photographic emulsion contains said coupler (ii) in an amount of 10 to 100 grams per mole of silver halide.

* * * * *